US006086341A

United States Patent [19]

Fukuhara et al.

[11] Patent Number: 6,086,341

[45] Date of Patent: Jul. 11, 2000

[54] ROTARY SCROLL FOR SCROLL COMPRESSOR AND METHOD OF MANUFACTURE THEREFOR

[75] Inventors: Hiroyuki Fukuhara, Otsu; Shigeru Muramatsu, Kusatsu; Kiyoji Aburaya; Yoshiharu Takeuchi, both of Otsu, all of Japan

[73] Assignee: Matsushita Electric Industrial Co., Ltd., Osaka, Japan

[21] Appl. No.: 08/924,088

[22] Filed: Sep. 5, 1997

[30] Foreign Application Priority Data

Sep. 6, 1996 [JP] Japan ..... 8-236338

[51] Int. Cl.[7] ..... F04C 18/04

[52] U.S. Cl. ..... 418/55.2; 418/179; 29/557

[58] Field of Search ..... 418/55.2, 179; 29/557, 888.022

[56] References Cited

U.S. PATENT DOCUMENTS 5,478,219 12/1995 Nardone et al. ..... 29/888.022

*Primary Examiner*—John J. Vrablik

*Attorney, Agent, or Firm*—McDermott, Will & Emery

[57] ABSTRACT

The present invention provides an aluminium near net material for making a rotary scroll. Even when there is a displacement due to level of die accuracy, error in machines used for machining processes and shift of processing fiducial, the invented near net material makes it possible to manufacture rotary scrolls without having skin of the original material staying in a finished rotary scroll, by determining the cutting margin 4 for spiral fin smaller than the cutting margin 5 for axis.

5 Claims, 5 Drawing Sheets

FIG. 8(a) *PRIOR ART*
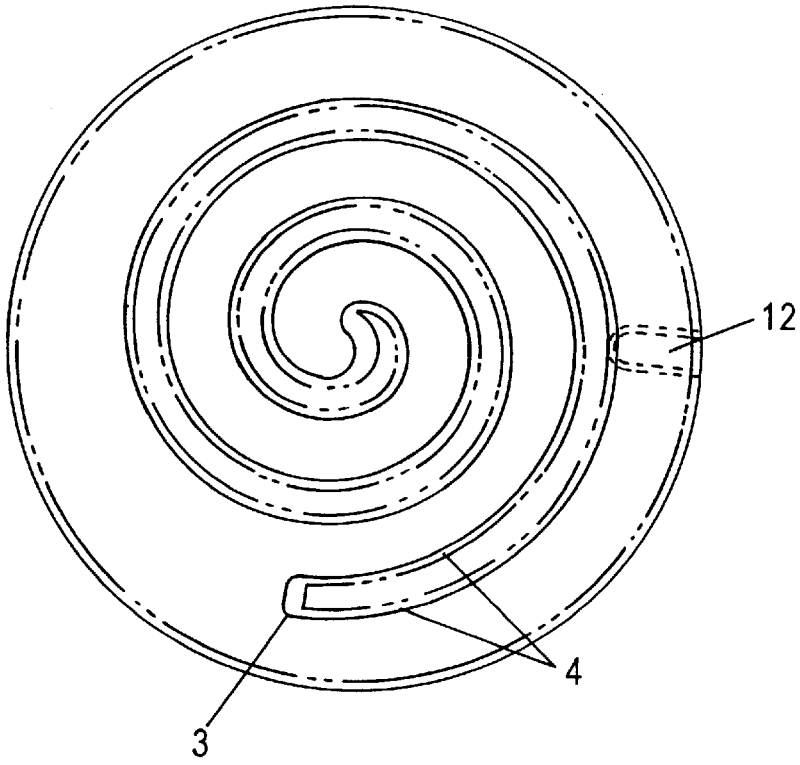
FIG. 8(b) *PRIOR ART*
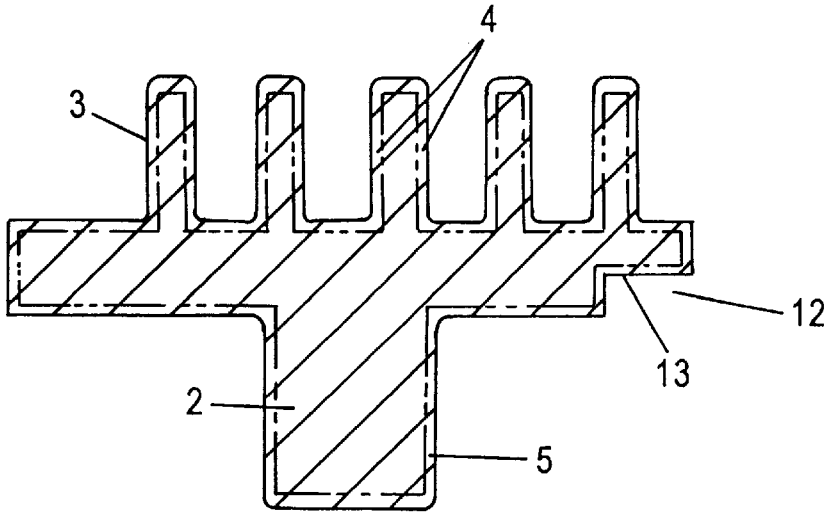

ROTARY SCROLL FOR SCROLL COMPRESSOR AND METHOD OF MANUFACTURE THEREFOR

BACKGROUND OF THE INVENTION

The present invention relates to a rotary scroll of scroll compressors used in professional and home use refrigerators/air conditioners, and method of manufacturing the rotary scroll.

In a conventional near net material for the rotary scroll comprising a spiral fin on one surface and an axis on the other surface of a base plate, and, as the case may be, a groove for driving, viz. key groove, disposed on a same surface as the axis, a same amount of cutting margin has been provided for each of the parts, as shown in FIG. 8(*a*) and FIG. 8(*b*); a cutting margin 4 for spiral fin 3, a cutting margin 5 for axis 2 and a cutting margin 13 for groove 12 having a same amount.

However, with the above described conventional arrangement of cutting margins, viz. a near net material provided with cutting margins of same amount for spiral fin 3 and axis 2, in a case where the cutting margins are determined small intending to reduce machining time for processing the fin part of spiral fin 3, the machining difficulty of which part is high, displacement due to the level of die accuracy, gap between the upper and lower dies, error in the machines used for machining processes, shift of the fiducial, etc. may cause skin of the near net material stay in a place of finished component where it is not admitted, which renders the component unusable. On the other hand, when the cutting margins are determined large, it takes much time to process the spiral fin 3, the machining difficulty of which part is high. Thus, it was difficult to present inexpensive rotary scrolls, hence, inexpensive scroll compressors.

SUMMARY OF THE INVENTION

To address the problem, an optimum, or a minimum required, cutting margin is provided for respective part of a near net material. Through which the present invention aims to present inexpensive scroll compressors.

The cutting margin for spiral fin is smaller than that for said axis in the invented near net material for rotary scroll. With the above described arrangement, time needed for machining the spiral fin, the machining difficulty of which portion being high, may be reduced; while the machining time for axis, the machining of which portion being easy, hardly increases. Furthermore, as displacement factors due to the level of die accuracy, gap between the upper and lower dies, error in the machines used for machining processes, shift of the fiducial, etc. are absorbed by the larger cutting margin provided for the axis, the problem of skin of near net material staying on a finished component in a place where it is not admitted is avoidable. This helps making the finished rotary scrolls readily available, enabling to present inexpensive scroll compressors.

In the present invention the cutting margin for an axis provided protruded on a base plate is larger than that for a spiral fin. With the above described arrangement of cutting margins, displacement due to the level of die accuracy, gap between the upper and lower dies, error in the machines used for machining processes, shift of the fiducial, etc. is absorbed by the large cutting margin for axis, machining of which being easy, without accompanying substantial extension of the machining time. Machining time may be reduced by the smaller cutting margin provided for the spiral fin, the machining difficulty of which being high.

In the present invention a near net material for rotary scroll comprising a spiral fin provided on one surface of a base plate and a protruding axis on the other surface of base plate, with which near net material the cutting margin for said spiral fin being smaller than that for said axis, has been formed using a same die(either upper die or lower die) with respect to said spiral fin and the outer circumference of said base plate. The near net material is first machined for the axis and approximately half the portion of the outer circumference in the length direction using the outer circumference of base plate as the fiducial, and then the spiral fin is machined using said machined portion of outer circumference as the fiducial. By so doing, the processing errors due to error in the machines used for machining processes and shift of the fiducial are absorbable by the large cutting margin provided for the axis, the machining of which is easy. Despite the larger cutting margin provided for axis, machining time for the axis hardly increases because the machining of axis is easy; despite the smaller cutting margin provided for spiral fin, the machining difficulty of which being high, the problem of original skin staying in a finished component hardly occurs; and the machining time may rather be reduced.

In the present invention, a rotary scroll is manufactured from a near net material comprising a spiral fin provided on one surface of a base plate, an axis provided protruded on the other surface of base plate and a groove for driving(so-called, key groove) provided on said base plate in a same surface as said axis, cutting margin provided for said spiral fin being smaller than that provided for said axis and said groove, which near net material has been formed using a same die(either upper die or lower die) with respect to said spiral fin and the outer circumference of said base plate. The near net material is first machined for the axis and approximately half the portion of outer circumference in the length direction using the outer circumference of base plate as the fiducial, and then the spiral fin is machined using said machined outer circumference as the fiducial, and finally the groove for driving disposed in a same surface as the axis is machined using the outer circumference and the spiral fin as the fiducial. By so doing, the processing errors due to the level of die accuracy, gap between the upper and lower dies, error in the machines used for machining processes and shift of the fiducial are absorbable by the large cutting margin provided for the axis and the groove. Despite the larger cutting margin provided for axis, processing time for the axis does not substantially increase because the machining of axis is easy. Time for machining the groove may be made shorter by providing a sort of hollow in advance in the near net material. Time for machining the spiral fin, the machining difficulty of which is high, may be made shorter because the cutting margin provided therefor is small.

BRIEF DESCRIPTION OF THE DRAWINGS

FIG. 1(*b*) is a cross sectional side view showing a rotary scroll according to a first exemplary embodiment of the present invention.

FIG. 8(*a*) is a plane view of a conventional near net material for rotary scroll.

FIG. 8(*b*) is a cross sectional side view showing a conventional near net material for rotary scroll.

DESCRIPTION OF THE PREFERRED EMBODIMENT

In the following, exemplary embodiments of the present invention are described with reference to drawings.

Embodiment 1

Figure 1A:
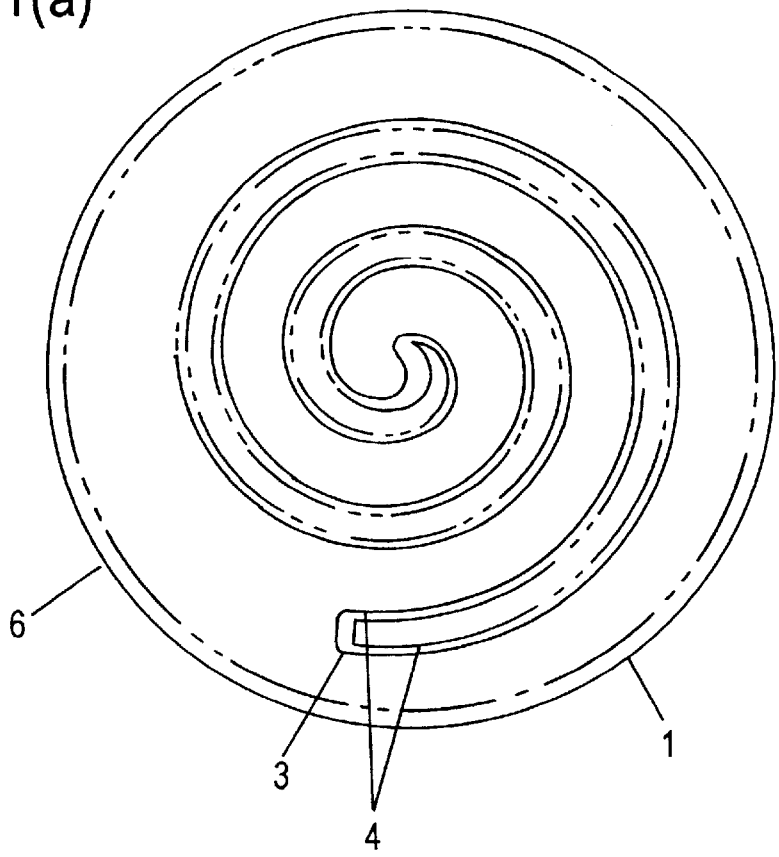
FIG. 1(*a*) is a plane view of a near net material for a rotary scroll according to a first exemplary embodiment of the present invention.
Figure 1B:
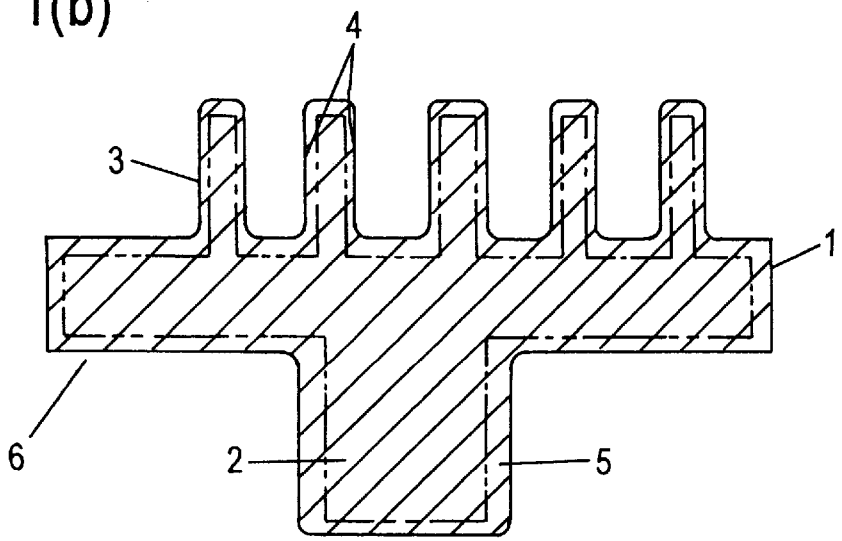

As shown in FIG. 1(*a*) and FIG. 1(*b*), a near net material 6 for rotary scroll made of aluminium alloy comprises an axis 2 on one surface of a base plate 1 and a spiral fin 3 on the other surface of a base plate 1, a cutting margin 5 for the axis 2 being larger than a cutting margin 4 for the spiral fin 3.

In the present exemplary embodiment in which the cutting margin 5 for axis 2, the machining of which is easy, is larger, the problem of skin of near net material staying in a finished component caused by displacement due to the level of die accuracy, gap between the upper and lower dies(in FIGS. 2, 8*a* and 8*b*), error in the machines used for machining processes and shift in the fiducial is preventable, without accompanying substantial increase of machining time. Although the cutting margin 4 provided for spiral fin 3, which is usually machined with an end-mill and the machining difficulty is high, is small, rejection of finished components due to staying of the skin of near net material hardly occurs because it is machined in accordance with the spiral fin 3, and displacement due to machining error and shift of the fiducial, which being a cause of the staying skin, is absorbed by the axis side. Furthermore, as the cutting margin 4 provided for spiral fin 3 is small the machining time therefor may be short. Which helps present inexpensive scroll compressors. The near net material 6 for rotary scroll is usually made of an aluminium alloy by e.g. casting of molten material into die or forging making use of plastic deformation of die. In any manufacturing process, it is very difficult to manufacture a near net scroll material having no displacement in the relative positioning between the spiral fin 3 and the axis 2, because there is a gap between the upper and lower dies. Further, because the forming is done in a temperature higher than normal, displacement due to thermal expansion or thermal displacement may not be avoided. Therefore, if the cutting margin is uniform and small the problem of original skin staying in a finished component arises as a result of displacement caused by error in machines used for the machining processes and shift of the fiducial. On the other hand, if the cutting margin is uniform and large it takes a long time for machining the spiral fin 3, the machining difficulty of which is high. This brings about an increased machining cost.

Embodiment 2

Figure 2:
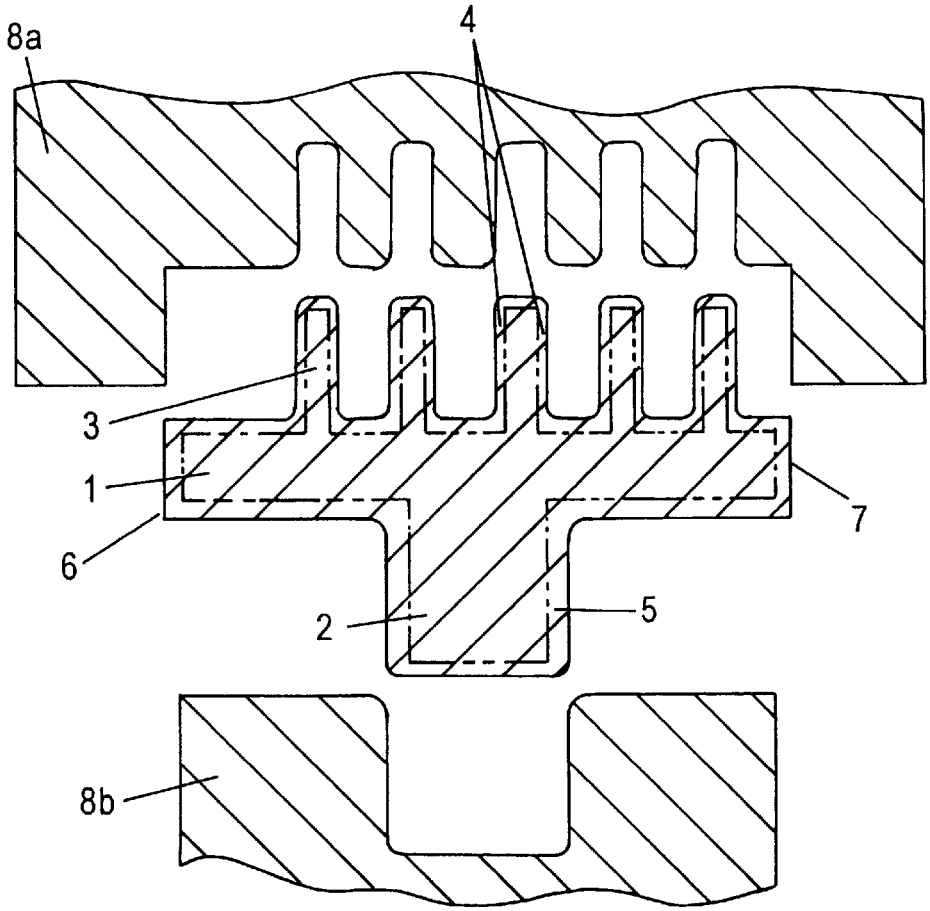
FIG. 2 is a cross sectional side view showing a near net material for a rotary acroll, as well as dies, according to a second exemplary embodiment of the present invention.

As shown in FIG. 2, a near net material 6 for rotary scroll of aluminium alloy comprises an axis 2 on one surface of a base plate 1 and a spiral fin 3 on the other surface of the base plate 1, in which the outer circumference 7 of the base plate and the spiral fin 3 are formed with a same die 8*a*.

A cutting margin 5 for the axis 2 is larger than a cutting margin 4 for the spiral fin 3.

Figure 3:
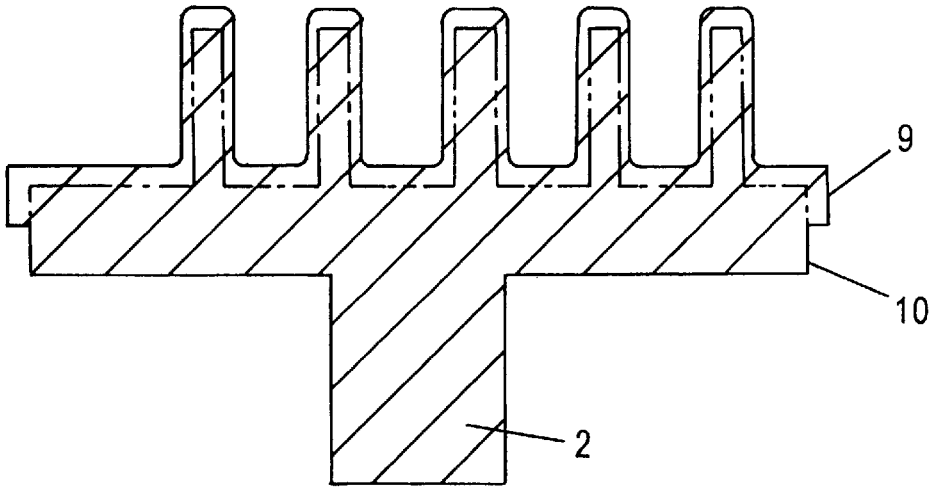
FIG. 3 describes a first step of machining the rotary scroll, according to the second exemplary embodiment of the present invention.
Figure 4:
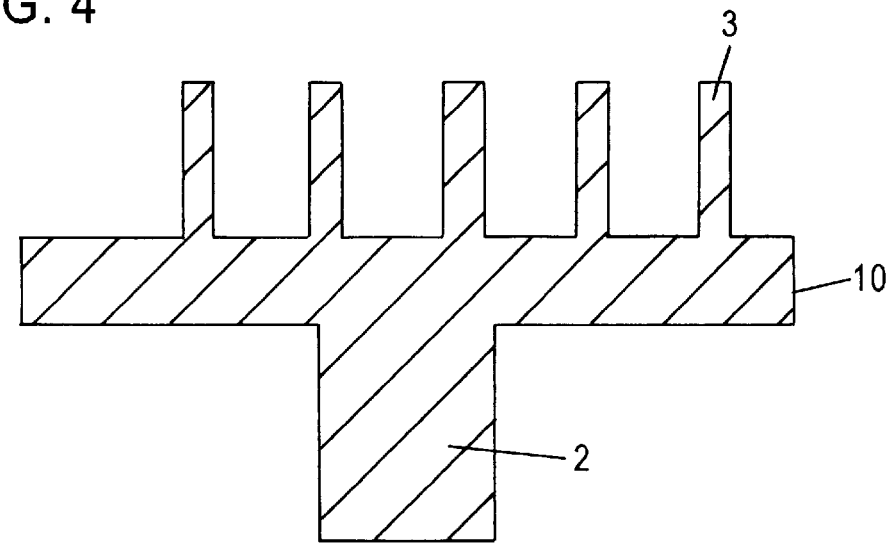
FIG. 4 describes a second step of machining the rotary scroll, according to the second exemplary embodiment of the present invention.

The relative displacement between the spiral fin 3 and the outer circumference 7 of base plate is very small because the two items have been formed with a same die 8*a*, while the displacement between the axis 2 and the outer circumference 7 of base plate is larger, for the amount of gap between the dies. Therefore, the problem of original skin staying in a finished component caused by displacement due to the level of die accuracy, gap between the upper and lower dies, error in machines used for the machining processes and shift of the fiducial is avoidable by firstly machining, as shown in FIG. 3, the axis 2 and approximately half the thickness portion 10 of outer circumference of base plate, which items are provided with the larger cutting margin but the machining is easy, using an approximately half the thickness portion 9 of outer circumference of base plate as the fiducial, and then, as shown in FIG. 4, machining the spiral fin 3, whose cutting margin being smaller, using the already-machined outer circumference 10 of base plate as the fiducial. There is almost no increase in the time for machining the axis 2, and because the spiral fin 3, which is usually machined with an end-mill and the machining difficulty is high, has the small cutting margin the time of machining processes may be reduced. This helps presenting inexpensive scroll compressors. The near net material 6 for rotary scroll is normally made of an aluminium alloy. Popular method of forming the material includes casting of molten item into die or forging by making use of plastic deformation with die. In any method, however, it is very difficult to manufacture a near net material in which there is no displacement in the relative positioning between the spiral fin 3 and the axis 2, because there always exists a gap between the upper die 8*a* and the lower die 8*b*. Furthermore, as the forming is done in a temperature higher than the normal temperature the displacement due to thermal expansion or thermal displacement is hardly avoidable. However, by manufacturing the spiral fin 3 and the outer circumference 7 with a same die 8*a*, the influence to be caused by the gap between upper and lower dies is eliminated. Therefore, a near net material thus manufactured has only a very small displacement between the outer circumference 7 and the spiral fin 3. As described above, by following the above machining fiducials even a near net material having only a small cutting margin for spiral fin 3 may yield a rotary scroll in which no original skin stays, in a short machining time, without rejects. Inexpensive rotary scrolls are thus presented for helping implement inexpensive scroll compressors.

Embodiment 3

Figure 5:
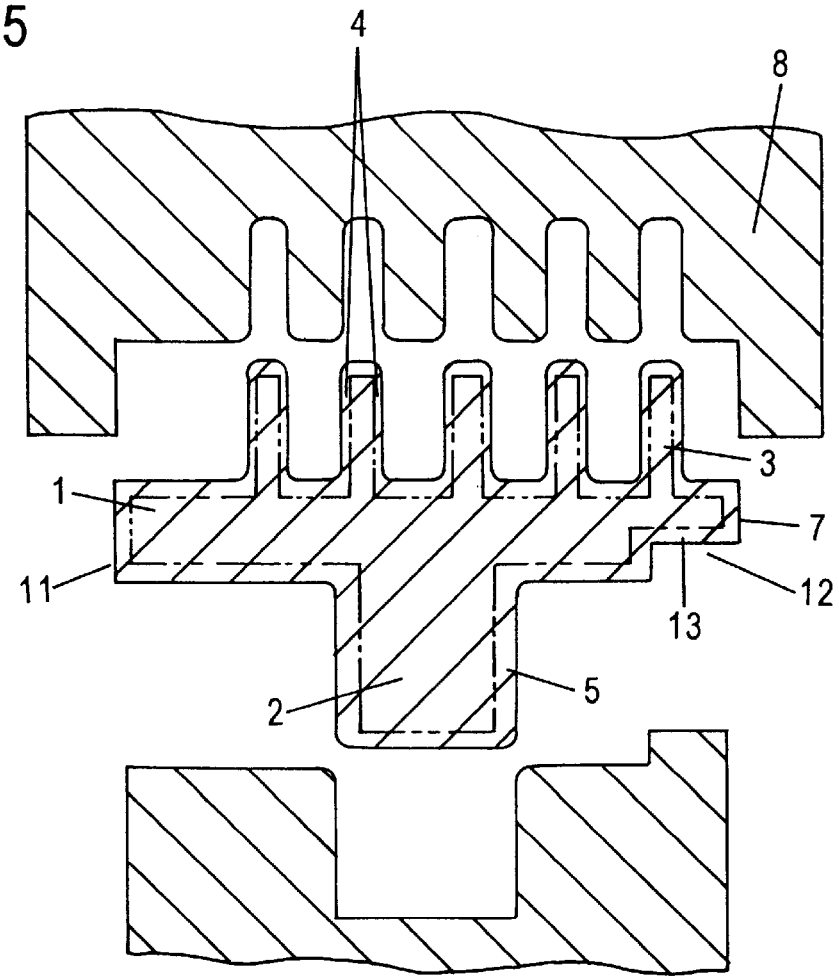
FIG. 5 is a cross sectional side view showing a near net material for a rotary scroll, as well as dies, according to a third exemplary embodiment of the present invention.

As shown in FIG. 5, a near net material 11 for rotary scroll of aluminium alloy comprises an axis 2 and a groove for driving 12 on one surface of a base plate 1 and a spiral fin 3 on the other surface of the base plate 1, in which the outer circumference 7 of the base plate and the spiral fin 3 are formed with a same die 8*a*.

A cutting margin 5 for the axis 2 and a cutting margin 13 for the groove 12 are larger than a cutting margin 4 for the spiral fin 3.

Figure 6:
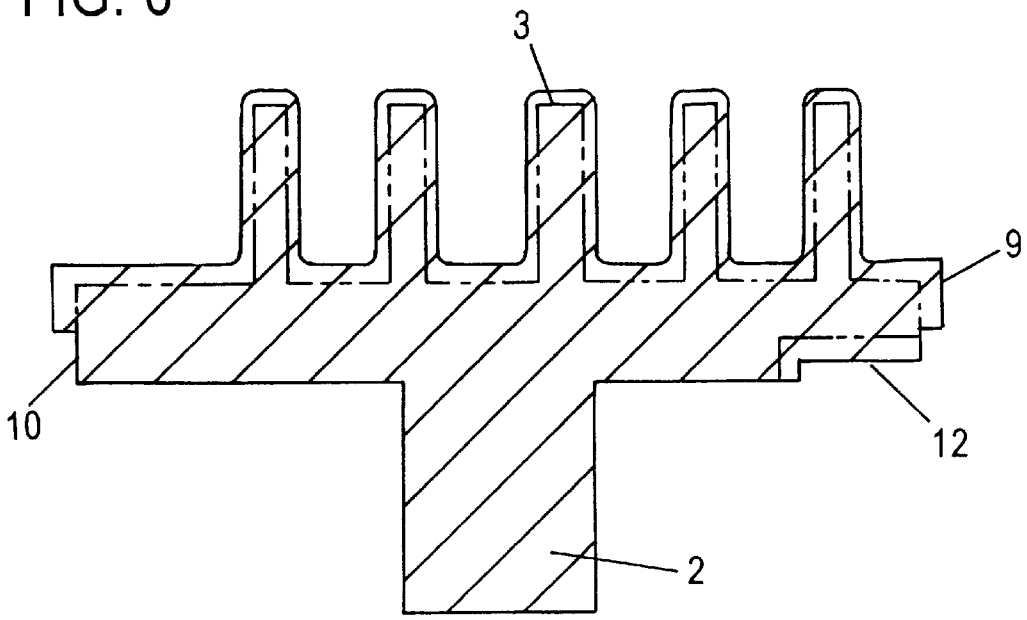
FIG. 6 describes a first step of machining the rotary scroll, according to the third exemplary embodiment of the present invention.
Figure 7:
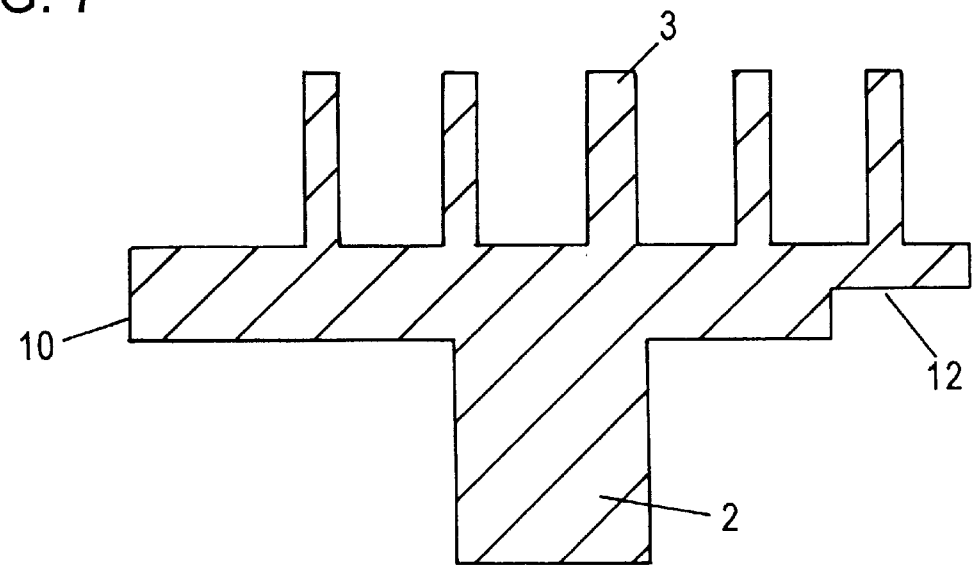
FIG. 7 describes a fourth step of machining the rotary scroll, according to the third exemplary embodiment of the present invention.

The relative displacement between the spiral fin 3 and the outer circumference 7 of base plate is very small because the two items have been formed with a same die 8*a*, while the displacement between the axis 2/groove 12 and the outer circumference 7 of base plate is larger, for the amount of gap between the upper die 8*a* and lower die 8*b*. Therefore, the problem of original skin staying in a finished component caused by displacement due to the level of die accuracy, gap between the upper and lower dies, error in machines used for the machining processes and shift of the fiducial is avoided by firstly machining, as shown in FIG. 6, the axis 2 and approximately half the thickness portion 10 of outer circumference of base plate, which items have been provided with the larger cutting margin but the machining is easy, using approximately half the thickness portion 9 of outer circumference of base plate as the fiducial, and then primary machining on the spiral fin 3, whose cutting margin being small, using the machined part of outer circumference 10 of base plate as the fiducial, and then machining the groove 12, having a larger cutting margin and being disposed in a same side as the axis, using the already-machined part of the outer circumference of base plate and the outer end of the primarily-machined part of the spiral fin as the fiducial, finally machining the spiral fin 3, as shown in FIG. 7, using the machined outer circumference 10 of base plate and groove 12 as the fiducial. There is almost no increase in the time for machining the axis 2, and the machining of groove 12 may be done within a short time because the corresponding portion has already been hollowed in the state of near net material providing only a small cutting margin; furthermore, because the spiral fin 3 and the groove 12, which are usually machined with an end-mill and the machining difficulty is high, have the small cutting margin the time of machining processes may be reduced. This helps presenting inexpensive scroll compressors. The near net material 11 for rotary scroll is normally made of an aluminium alloy. Popular method of forming the near net material includes casting of molten item into die or forging by making use of plastic deformation with die. In any method, however, it is very difficult to manufacture a near net material in which there is no displacement in the relative positioning among the spiral fin 3, axis 2 and the groove 12, because there always exists a gap between the upper die and the lower die. Furthermore, as the forming is done in a temperature higher than the normal temperature the displacement due to thermal expansion or thermal displacement is hardly avoidable. However, by manufacturing the spiral fin 3 and the outer circumference 7 with a same die 8*a* the influence to be caused by the gap between upper and lower dies is eliminated. Therefore, a near net material thus manufactured has only a very small displacement between the outer circumference 7 and the spiral fin 3. As described above, by following the above machining fiducials even a near net material having only a small cutting margin for spiral fin 3 may yield a rotary scroll in which no original skin stays, in a short machining time, without rejects. Inexpensive rotary scrolls are thus presented for implementing inexpensive scroll compressors.

In the above exemplary embodiments, although the description was made on holding the axis 2 after cutting the outer diameter, the same of course applies to a case where the axis 2 is held by a hole provided therein.

As described in the above exemplary embodiments, in the present invention the cutting margin for a spiral fin is smaller than that for an axis. With such arrangement of cutting margins, the displacement during machining processes is absorbable by the cutting margin for axis, the machining of which being easy, without substantially increasing the machining time. While, the machining time of spiral fin, the machining difficulty of which portion is high, may be reduced by providing a smaller cutting margin. Good components without the original skin staying on them are thus readily available, for presenting inexpensive scroll compressors.

In the present invention a near net material for rotary scroll, with which the cutting margin for spiral fin being smaller than that for axis, is formed using a same die with respect to the spiral fin and the outer circumference of base plate. Because the spiral fin and the outer circumference of base plate are made with a same die the displacement between them is very small, while the displacement between the axis and the outer circumference of base plate is large, for the amount of gap between the upper and lower dies. The near net material is first machined for the axis and approximately half the portion of the outer circumference, which items have larger cutting margin but the machining is easy, using approximately half the thickness portion of outer circumference of base plate as the fiducial, and then the spiral fin, whose cutting margin is small, is machined using the already-machined outer circumference as the fiducial. By so doing, the problem of original skin staying in a finished component caused by the level of die accuracy, gap between the upper and lower dies, error in machines used for the machining processes and shift of the fiducial may be avoided. In this way, the machining time of axis, the machining of which is easy, hardly increases, and the spiral fin, the machining difficulty of which is high and the cutting margin therefor is small, may be machined in a short time, without leaving the original skin. Thus, inexpensive components, hence inexpensive scroll compressors are presented.

In the present invention net material for rotary scroll is manufactured with a same die for the spiral fin and the outer circumference of base plate, and the cutting margin for spiral fin is smaller than that for the axis and the groove. Because the spiral fin and the outer circumference of base plate are made with a same die the displacement between them is very small, while the displacement between the axis/groove and the outer circumference of base plate is large, for the amount of gap between the dies. The problem of original skin staying in a finished component caused by displacement due to error in machines used for the machining processes and shift of the fiducial is avoidable by firstly machining the axis and approximately half the portion of outer circumference of base plate, which items are provided with the larger cutting margin but the machining is easy, using approximately half the thickness portion of outer circumference of base plate as the fiducial, and then primary machining on the spiral fin, whose cutting margin being smaller, using the already-machined outer circumference of base plate as the fiducial, and then machining the groove having a larger cutting margin using the already-machined portion of the outer circumference of base plate and the spiral fin as the fiducial, finally machining the spiral fin using the machined outer circumference of base plate and groove as the fiducial. There is almost no increase in the time for machining the axis, and the machining of groove may be done within a short time because the corresponding portion has already been hollowed in the state of near net material providing only a small cutting margin; further, because the spiral fin, whose machining difficulty is high, has a small cutting margin the time of machining processes may be reduced. Good components having no original skin left thereon are thus readily obtainable. This helps presenting inexpensive scroll compressors.

What is claimed is:

1. A near net material for rotary scroll of scroll compressor formed into a single body from an aluminium alloy, comprising a spiral fin provided protruded on one surface of a base plate, and an axis provided protruded on the other surface of the base plate; wherein cutting margin for said spiral fin is smaller than that for said axis.

2. A rotary scroll for scroll compressor, which is made from a near net material for rotary scroll formed into a single body with an aluminium alloy comprising a spiral fin provided protruded on one surface of a base plate, and an axis provided protruded on the other surface of the base plate, in which near net material the cutting margin for said spiral fin being smaller than that for said axis.

3. A near net material for rotary scroll of scroll compressor formed into a single body from an aluminium alloy comprising a spiral fin provided protruded on one surface of a base plate and an axis provided protruded on the other surface of the base plate; wherein cutting margin for said spiral fin is smaller than that for said axis, and said spiral fin and outer circumference of said base plate are formed with a same die.

4. A rotary scroll of scroll compressor, which is made from a near net material for rotary scroll formed into a single body from an aluminium alloy comprising a spiral fin provided protruded on one surface of a base plate and an axis provided protruded on the other surface of the base plate, in which near net material cutting margin for said spiral fin being smaller than that for said axis, and said spiral fin and outer circumference of said base plate being formed with a same die.

5. A rotary scroll of scroll compressor, which is made from a near net material for rotary scroll formed into a single body from an aluminium alloy comprising a spiral fin provided protruded on one surface of a base plate, an axis provided protruded on the other surface of the base plate and a groove for driving provided on said base plate in a same surface as said axis, in which near net material cutting margin for said spiral fin being smaller than that for said axis and said groove for driving, and said spiral fin and outer circumference of said base plate being formed with a same die.

* * * * *